US006619216B2

(12) United States Patent
Lin

(10) Patent No.: US 6,619,216 B2
(45) Date of Patent: Sep. 16, 2003

(54) INCINERATOR WITH A DRYER AND A CONTROL UNIT FOR CONTROLLING TEMPERATURE IN THE DRYER

(76) Inventor: Dai-You Lin, No. 1069, Chung-Cheng Rd., Wu-Feng Hsiang, Taichung Hsien (TW)

( * ) Notice: Subject to any disclaimer, the term of this patent is extended or adjusted under 35 U.S.C. 154(b) by 0 days.

(21) Appl. No.: 10/132,124

(22) Filed: Apr. 24, 2002

(65) Prior Publication Data

US 2003/0097969 A1 May 29, 2003

(30) Foreign Application Priority Data

Nov. 28, 2001 (TW) ..... 90220597 U

(51) Int. Cl.[7] ..... F23M 9/00; F23N 5/24; F23K 3/00; F26B 19/00

(52) U.S. Cl. ..... 110/233; 110/322; 110/308; 110/193; 110/101 CA; 110/101 C; 110/186; 110/190; 34/446; 34/575; 34/90

(58) Field of Search ..... 110/308, 208, 110/210, 233, 193, 235, 297, 302, 303, 304, 101 CA, 267, 101 R, 101 C, 101 CF, 185, 186, 190, 322; 34/427, 446, 524, 573, 575, 90, 86, 170

(56) References Cited

U.S. PATENT DOCUMENTS 2,069,584 A * 2/1937 Lorton ..... 110/13
3,859,174 A * 1/1975 Taylor ..... 203/10
3,958,920 A * 5/1976 Anderson ..... 432/23
4,060,042 A * 11/1977 Baraldi et al. ..... 110/14
4,311,103 A * 1/1982 Hirose ..... 110/238
4,315,468 A * 2/1982 Tyer et al. ..... 110/101 CF
4,517,902 A * 5/1985 Christian ..... 110/190
5,315,938 A * 5/1994 Freller ..... 110/233
5,341,637 A * 8/1994 Hamrick ..... 60/39.464
5,799,590 A * 9/1998 Noguchi ..... 110/216

* cited by examiner

*Primary Examiner*—Ira S. Lazarus
*Assistant Examiner*—K. B. Rinehart
(74) *Attorney, Agent, or Firm*—Sheridan Ross PC

(57) ABSTRACT

An incinerator includes a furnace, a heat-insulating shield, an air conduit, an air blower, and a dryer. The heat-insulating shield has a top wall, a vertically extending peripheral wall that extends downwardly from the top wall and that surrounds and that is spaced apart from the furnace by a gap, and an open bottom end. The peripheral wall of the heat-insulating shield has an air outlet that is disposed adjacent to the top wall and that is in fluid communication with the gap. Atmospheric air is introduced via the open bottom end through the gap and the air conduit and into the dryer. A feed motor is used to deliver solid waste into the furnace. A control unit controls rotating speed of the feed motor based on temperature in the dryer so as to adjust the temperature in the dryer.

3 Claims, 5 Drawing Sheets

INCINERATOR WITH A DRYER AND A CONTROL UNIT FOR CONTROLLING TEMPERATURE IN THE DRYER

BACKGROUND OF THE INVENTION

This invention relates to an incinerator, more particularly to an incinerator with a dryer and a control unit for controlling temperature in the dryer.

SUMMARY OF THE INVENTION

The object of the present invention is to provide an incinerator with a heat-insulating shield that surrounds a furnace for heating air in a gap therebetween. The heated air is then used for drying crops in a dryer. The temperature in the dryer is controlled by using a temperature sensor and a control unit which controls a feed motor, a rake motor, and an air-flow controller of the incinerator.

According to the present invention, an incinerator comprises: a furnace adapted to incinerate solid waste and including a vertically extending peripheral wall having a bottom section defining a main combustion chamber, an intermediate section extending upwardly from the bottom section to define an auxiliary combustion chamber, and a top section extending upwardly from the intermediate section and formed with an effluent outlet for exit of a combustion gas generated in the main and auxiliary combustion chambers; a feeding unit including a feed motor for delivering solid waste into the furnace; a cyclone separator connected to the effluent outlet for receiving the combustion gas from the furnace; a heat-insulating shield having a top wall, a vertically extending peripheral wall that extends downwardly from the top wall and that surrounds and that is spaced apart from the peripheral wall of the furnace by a gap, and an open bottom end, the top section of the peripheral wall of the furnace extending outwardly through the top wall, the effluent outlet being disposed outwardly of the heat-insulating shield, the peripheral wall of the heat-insulating shield having an air outlet that is disposed adjacent to the top wall and that is in fluid communication with the gap; an air conduit connected to the air outlet and in fluid communication with the gap via the air outlet; a dryer connected to and in fluid communication with the air conduit; an air blower disposed downstream of the air outlet for introducing atmospheric air via the open bottom end through the gap and the air conduit and into the dryer such that the introduced atmospheric air is heated in the gap by virtue of heat flow from the peripheral wall of the furnace into the gap; a temperature sensor mounted in the dryer for measuring temperature in the dryer and for generating an electrical signal that corresponds to the temperature in the dryer; and a control unit electrically connected to the temperature sensor for receiving the electrical signal and further connected to the feed motor for controlling rotating speed of the feed motor based on the temperature in the dryer so as to adjust the temperature in the dryer.

BRIEF DESCRIPTION OF THE DRAWINGS

In drawings which illustrate an embodiment of the invention.

DETAILED DESCRIPTION OF THE PREFERRED EMBODIMENT

Figure 1:
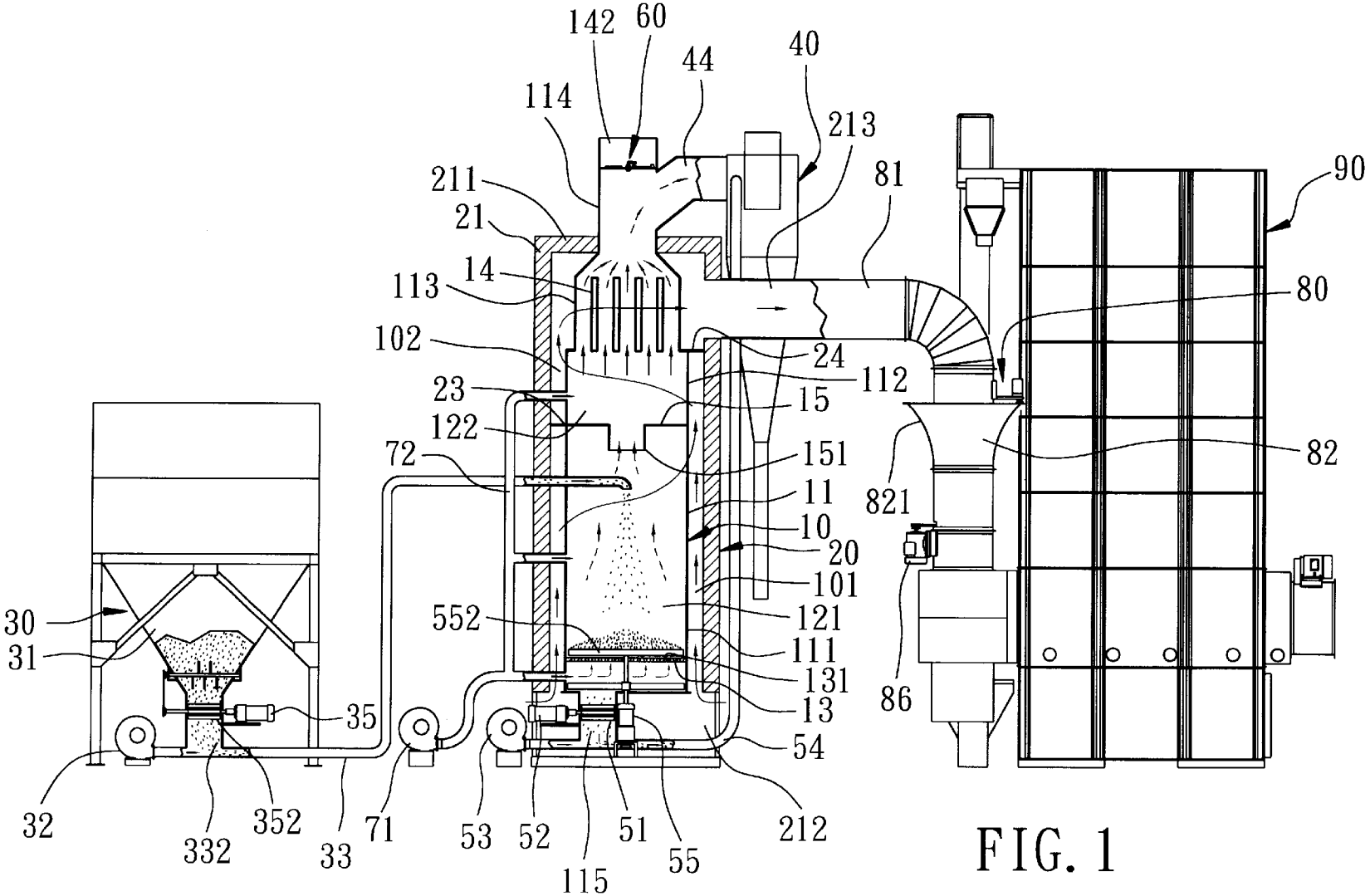
FIG. 1 is a schematic view of an incinerator embodying this invention.

FIGS. 1 to 5 illustrate a preferred embodiment of an incinerator of this invention for combustion of solid waste, such as hull or shell waste of agricultural crops.

The incinerator includes: a furnace 10 having a vertically extending peripheral wall 11 with a bottom section 111 defining a main combustion chamber 121, an intermediate section 112 extending upwardly from the bottom section 111 to define an auxiliary combustion chamber 122, a cooling section 113 extending upwardly from the intermediate section 112, and a top section 114 extending upwardly from the cooling section 113 and formed with an effluent outlet 44 for exit of a combustion gas generated in the main and auxiliary combustion chambers 121, 122, a partition plate 15 being disposed in the furnace 10 to separate the main and auxiliary combustion chambers 121, 122 and being formed with a channel 151 that is in fluid communication with the main and auxiliary combustion chambers 121, 122; a feeding unit including a feed motor 35 for delivering solid waste into said furnace 10; a cooler 14 disposed in the cooling section 113 for cooling the combustion gas passing therethrough; a cyclone separator 40 connected to the effluent outlet 44 for receiving the combustion gas from the furnace 10; a heat-insulating shield 20 having a top wall 211, a vertically extending peripheral wall 21 that extends downwardly from the top wall 211 and that surrounds and that is spaced apart from the peripheral wall 11 of the furnace 10 by a gap 101, and an open bottom end 212, the top section 114 of the peripheral wall 11 of the furnace 10 extending outwardly through the top wall 211, the effluent outlet 44 being disposed outwardly of the heat-insulating shield 20, the peripheral wall 21 of the heat-insulating shield 20 having an air outlet 213 that is disposed adjacent to the top wall 211 and that is in fluid communication with the gap 101; an air conduit connected to the air outlet 213 and in fluid communication with the gap 101 via the air outlet 213; a dryer 90 connected to and in fluid communication with the air conduit; an air blower 86 disposed downstream of the air outlet 213 and mounted on the air conduit for introducing atmospheric air via the open bottom end 212 through the gap 101 and the air conduit 213 and into the dryer 90 such that the introduced atmospheric air is heated in the gap 101 by virtue of heat flow from the peripheral wall 11 of the furnace 10 into the gap 101; a temperature sensor 200 (see FIG. 5) mounted in the dryer 90 for measuring temperature in the dryer 90 and for generating an electrical signal that corresponds to the temperature in the dryer 90; and a control unit 300 electrically connected to the temperature sensor 200 for receiving the electrical signal and further connected to the feed motor 35 for controlling rotating speed of the feed motor 35 based on the temperature in the dryer 90 so as to vary feeding rate of solid waste into the furnace 10 and so as to adjust the temperature in the dryer 90.

The heat-insulating shield 20 is formed with a plurality of baffles 23, 24 interconnecting the peripheral wall 21 of the heat-insulating shield 20 and the peripheral wall 11 of the furnace 10 so as to form a tortuous channel 102 thereamong for passage of the hot air flowing in the gap 101.

Figure 2:
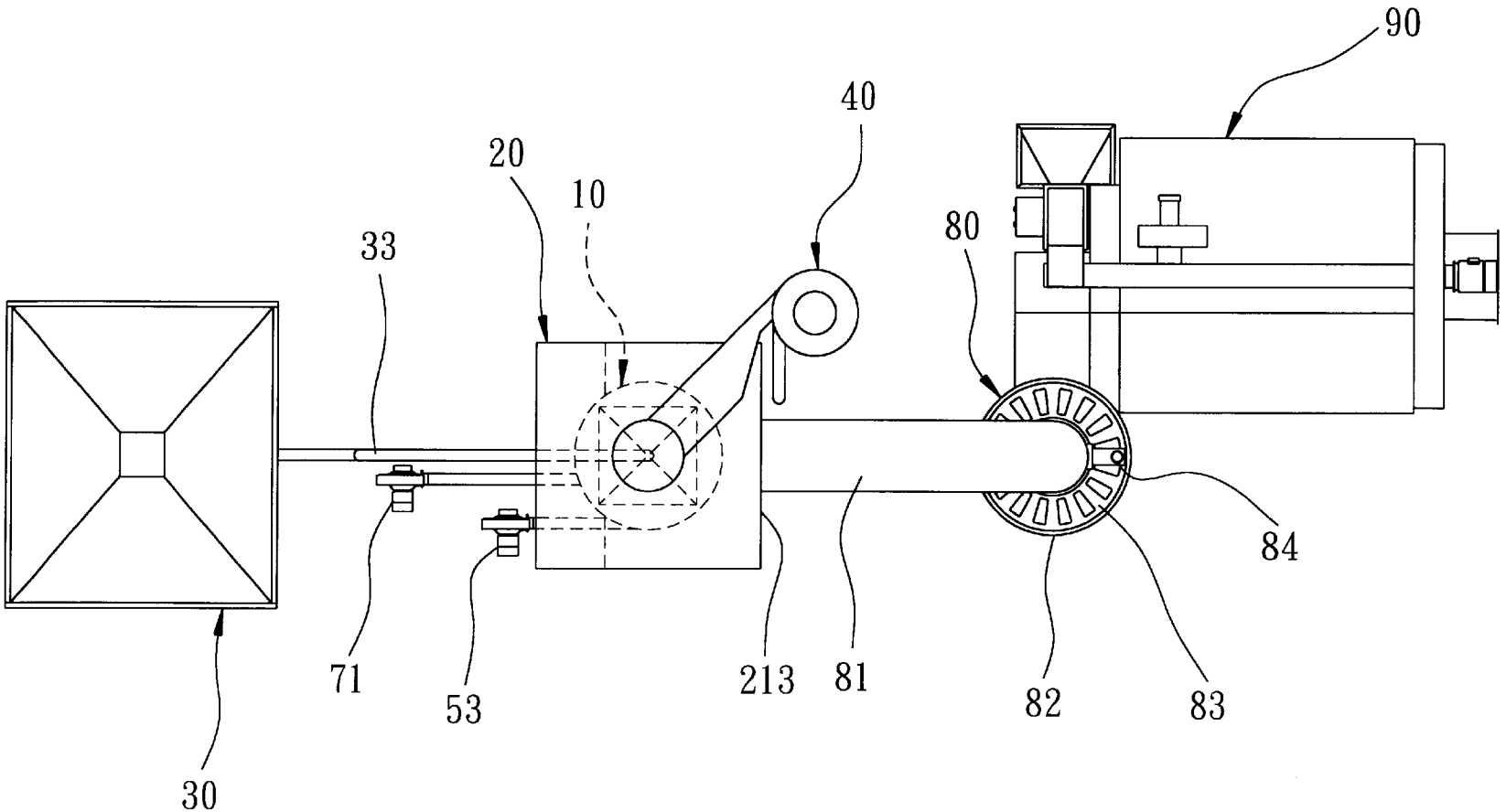
FIG. 2 is a schematic top view of the incinerator of FIG. 1.
Figure 3:
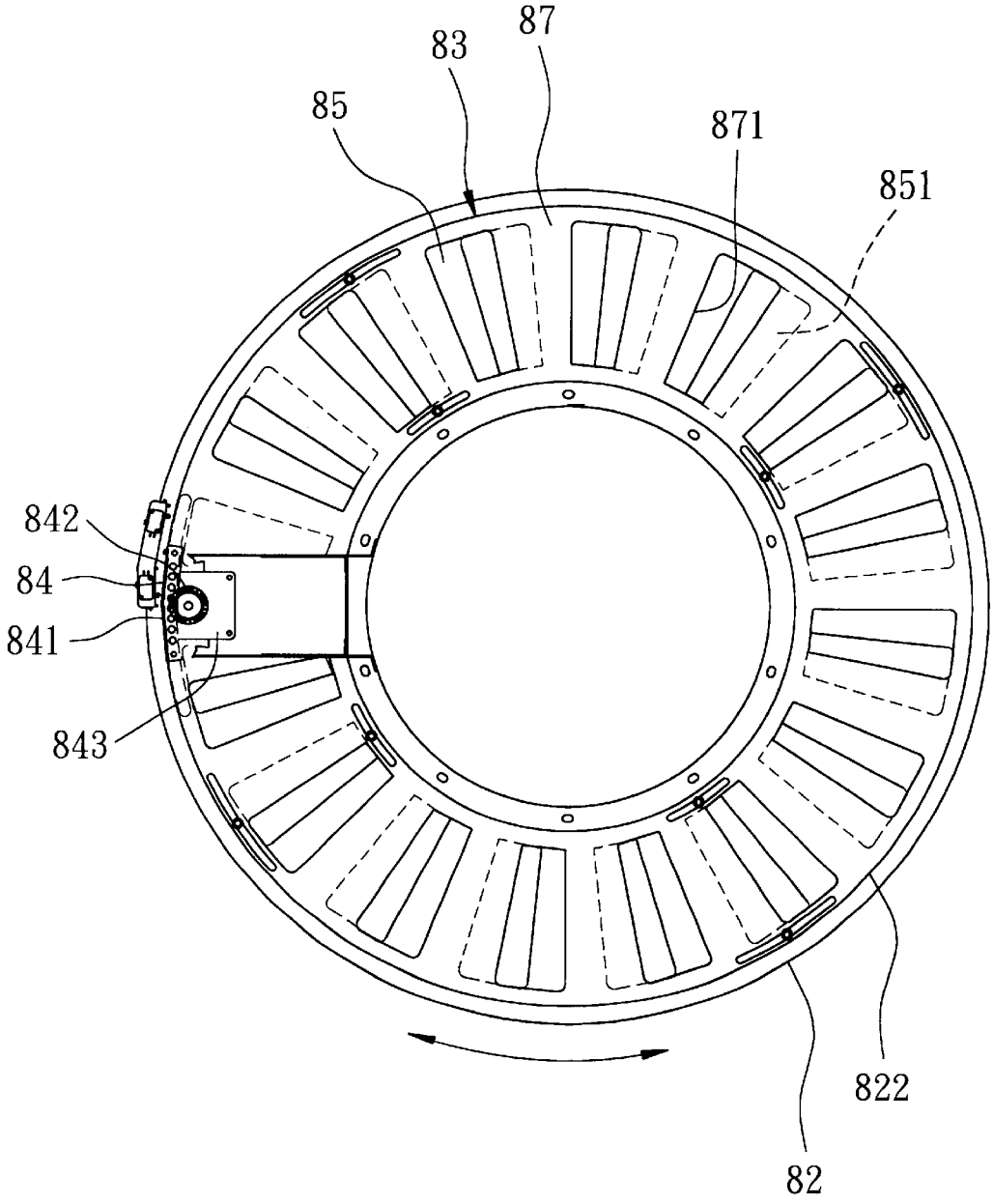
FIG. 3 is a schematic top view to illustrate how an air-flow controller of the incinerator of FIG. 1 is operated to open a control valve.
Figure 4:
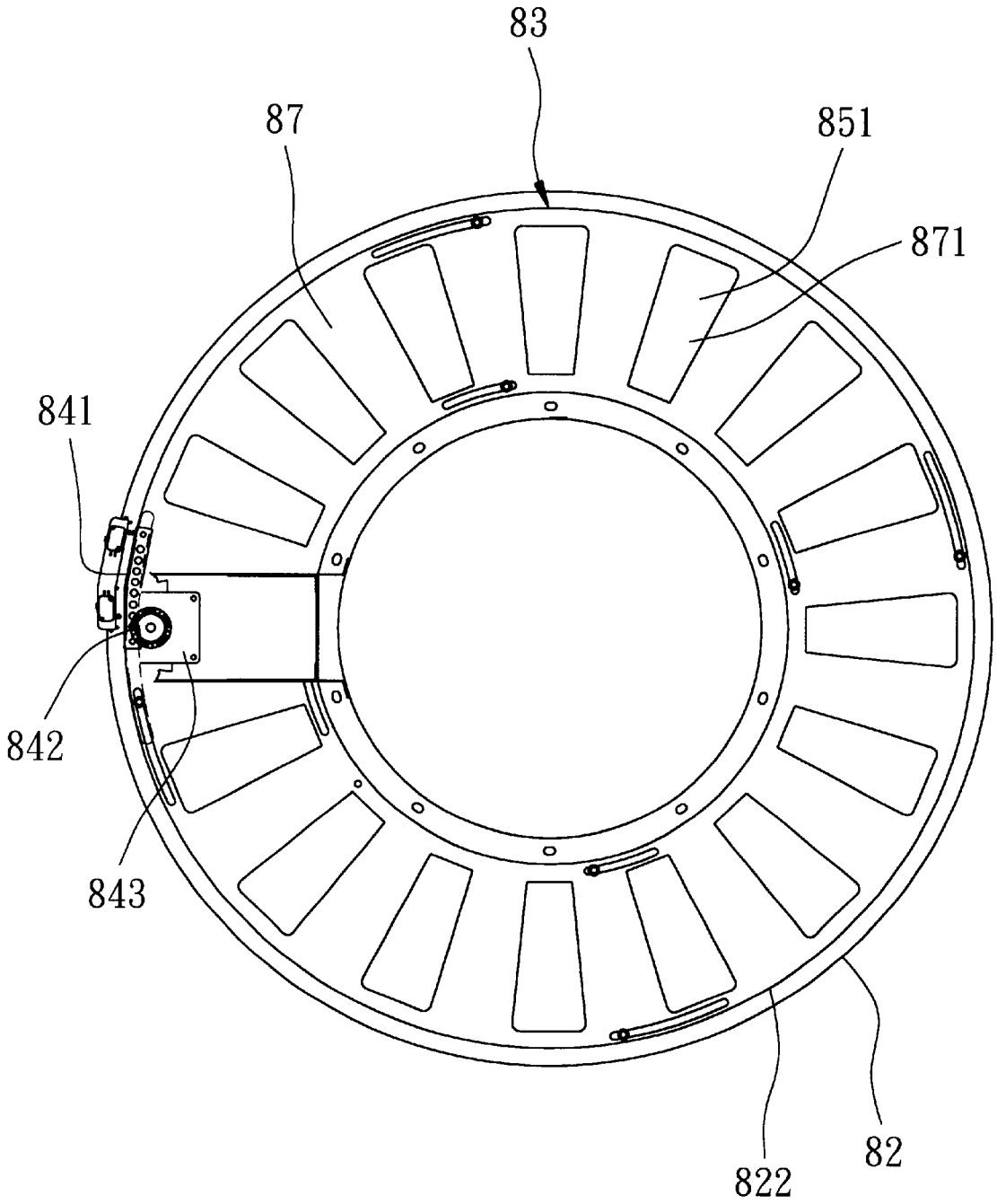
FIG. 4 is a schematic top view to illustrate how the air flow controller of FIG. 5 is operated to close the control valve.
Figure 5:
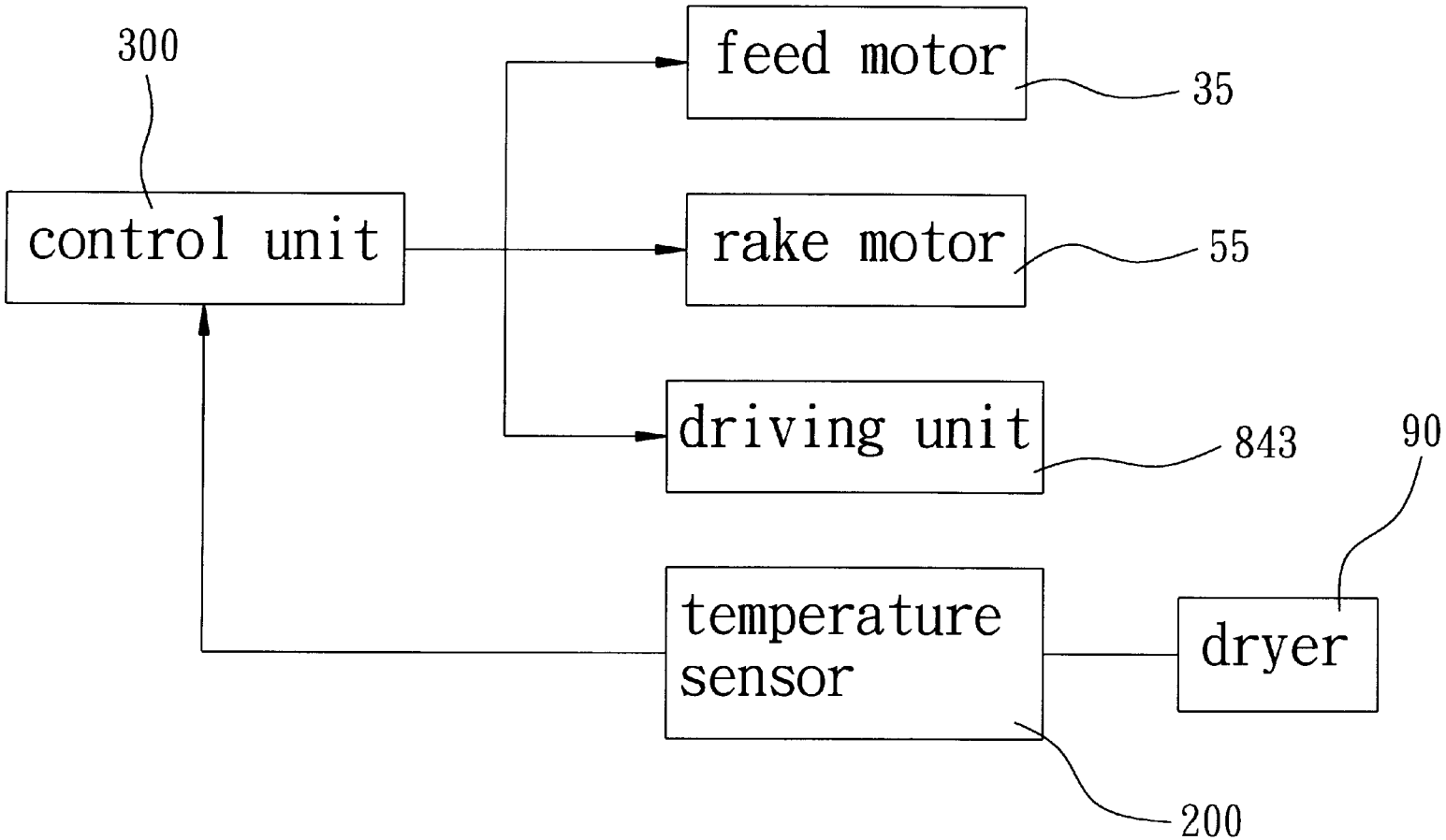
FIG. 5 is a block diagram showing a dryer, a feed motor, a rake motor, and a driving unit controlled by a control unit upon receiving an electrical signal from a temperature sensor that is disposed in the dryer.

Referring to FIGS. 2 to 4, the air conduit has first and second sections 81, 82. An air-flow controller 80 is disposed between the first and second sections 81, 82, and includes a control valve 83, a pinion-and-rack unit 84, and a driving unit 843 mounted on the air conduit. The first section 81 has one end connected to the air outlet 213, and an opposite end connected to the second section 82. The second section 82 has an enlarged end 821 which has an inner wall 822, which receives the opposite end of the first section 81, and which converges in a direction toward an opposite end of the second section 82 opposite to the enlarged end 821. The control valve 83 is disposed in the enlarged end 821 of the second section 82, and includes a lower disc 85 that extends radially and inwardly from the inner wall 822 around the opposite end of the first section 81, and an upper disc 87 that is rotatably stacked on the lower disc 85. The upper and lower discs 87, 85 are formed with angularly spaced apart upper and lower slots 871, 851 around the opposite end of the first section 81. The pinion-and-rack unit 84 includes a rack 841 secured to the upper disc 87, and a pinion 842 coupled to the driving unit 843 and meshing with the rack 841 so as to permit rotation of the upper disc 87 relative to the lower disc 85 between an open position (see FIGS. 3 and 4), in which, the upper and lower slots 871, 851 overlap, thereby permitting atmospheric air to be introduced into the enlarged end 821 of the second section 82 via the upper and lower slots 871, 851 upon actuation of the air blower 86, and a closed position, in which, the upper and lower slots 871, 851 are offset from each other and are closed by the lower and upper discs 85, 87, respectively, thereby preventing atmospheric air from flowing into the enlarged end 821 of the second section 82 via the upper and lower slots 871, 851. The control unit 300 is electrically connected to the driving unit 843 for moving the upper disc 87 between the open and closed positions based on the temperature in the dryer 90 so as to vary flow rate of atmospheric air into the air conduit via the upper and lower slots 871, 851 and so as to adjust the temperature in the dryer 90.

A feeding device 30 is connected to the furnace 10 for feeding the solid waste into the furnace 10, and includes a hopper 31 with a bottom outlet 332, a rotary wheel 352 driven by the feed motor 35 and rotatably disposed in the hopper 31 for feeding the solid waste to the bottom outlet 332, a pipe 33 interconnecting the bottom outlet 332 and the furnace 10, and a blower 32 connected to the bottom outlet 332 for delivering the solid waste into the furnace 10 via the pipe 33.

A main blower 71 is connected to the furnace 10 via an air pipe 72 for delivering air into the furnace 10.

A perforated supporting plate 13 is disposed in the bottom section 111 of the furnace 10 for supporting the solid waste, and is formed with a plurality of holes 131 for passage of ash therethrough. Ash falling from the supporting plate 13 via the holes 131 is transferred to a bottom exit 115 of the furnace 10 via a second rotary wheel 51 driven by a motor 52. Another blower 53 is connected to the bottom exit 115 for delivering the falling ash into the cyclone separator 40 via a pipe 54. A rake 552 is disposed rotatably over the supporting plate 13 for stirring ash on the supporting plate 13 and for facilitating falling of ash through the holes 131 so as to increase combustion efficiency of the furnace 10. A rake motor 55 is connected to the rake 552 for rotating the rake 552. The control unit 300 is electrically connected to the rake motor 55 for controlling rotating speed of the rake motor 55 based on the temperature in the dryer 90 so as to adjust the temperature in the dryer 90.

With the invention thus explained, it is apparent that various modifications and variations can be made without departing from the spirit of the present invention. It is therefore intended that the invention be limited only as recited in the appended claims.

I claim:

1. An incinerator comprising:

a furnace adapted to incinerate solid waste and including a vertically extending peripheral wall having a bottom section defining a main combustion chamber, an intermediate section extending upwardly from said bottom section to define an auxiliary combustion chamber, and a top section extending upwardly from said intermediate section and formed with an effluent outlet for exit of a combustion gas generated in said main and auxiliary combustion chambers;

a feeding unit including a feed motor for delivering solid waste into said furnace;

a cyclone separator connected to said effluent outlet for receiving the combustion gas from said furnace;

a heat-insulating shield having a top wall, a vertically extending peripheral wall that extends downwardly from said top wall and that surrounds and that is spaced apart from said peripheral wall of said furnace by a gap, and an open bottom end, said top section of said peripheral wall of said furnace extending outwardly through said top wall, said effluent outlet being disposed outwardly of said heat-insulating shield, said peripheral wall of said heat-insulating shield having an air outlet that is disposed adjacent to said top wall and that is in fluid communication with said gap;

an air conduit connected to said air outlet and in fluid communication with said gap via said air outlet;

a dryer connected to and in fluid communication with said air conduit;

an air blower disposed downstream of said air outlet for introducing atmospheric air via said open bottom end through said gap and said air conduit and into said dryer such that the introduced atmospheric air is heated in said gap by virtue of heat flow from said peripheral wall of said furnace into said gap;

a temperature sensor mounted in said dryer for measuring temperature in said dryer and for generating an electrical signal that corresponds to the temperature in said dryer; and a control unit electrically connected to said temperature sensor for receiving said electrical signal and further connected to said feed motor for controlling rotating speed of said feed motor based on the temperature in said dryer so as to adjust the temperature in said dryer.

2. The incinerator of claim 1, wherein said furnace further includes a perforated supporting plate disposed in said main combustion chamber for supporting solid waste thereon, said supporting plate being formed with a plurality of holes for passage of ash therethrough, said furnace further including a rake that is disposed rotatably over said supporting plate for stirring ash on said supporting plate and for facilitating falling of ash through said holes so as to increase combustion efficiency of said furnace, said incinerator further comprising a rake motor for rotating said rake, said control unit being electrically connected to said rake motor for controlling rotating speed of said rake based on the temperature in said dryer so as to adjust the temperature in said dryer.

3. The incinerator of claim 2, wherein said air conduit has first and second sections, said incinerator further comprising an air-flow controller which is disposed between said first and second sections and which includes a control valve, a pinion-and-rack unit, and a driving unit mounted on said air conduit, said first section having one end connected to said air outlet, and an opposite end connected to said second section, said second section having an enlarged end which has an inner wall, which receives said opposite end of said first section, and which converges in a direction toward an opposite end of said second section opposite to said enlarged end, said control valve being disposed in said enlarged end of said second section, and including a lower disc that extends radially and inwardly from said inner wall around said opposite end of said first section, and an upper disc that is rotatably stacked on said lower disc, said upper and lower discs being formed with angularly spaced apart upper and lower slots around said opposite end of said first section, said pinion-and-rack unit including a rack secured to said upper disc, and a pinion coupled to said driving unit and meshing with said rack so as to permit rotation of said upper disc relative to said lower disc between an open position, in which, said upper and lower slots overlap, thereby permitting atmospheric air to be introduced into said air conduit via said upper and lower slots upon actuation of said air blower, and a closed position, in which, said upper and lower slots are offset from each other and are closed by said lower and upper discs, respectively, thereby preventing atmospheric air from flowing into said air conduit via said upper and lower slots, said control unit being electrically connected to said driving unit for moving said upper disc between said open and closed positions so as to adjust the temperature in said dryer.

* * * * *

UNITED STATES PATENT AND TRADEMARK OFFICE

CERTIFICATE OF CORRECTION

PATENT NO. : 6,619,216 B2
DATED : September 16, 2003
INVENTOR(S) : Lin

It is certified that error appears in the above-identified patent and that said Letters Patent is hereby corrected as shown below:

Title page,
Item [30], Foreign Application Priority Data, please delete
"[30] Foreign Application Priority Data
Nov. 28, 2001 (TW) ..... 90220597 U"

Signed and Sealed this

Twenty-seventh Day of January, 2004

JON W. DUDAS
*Acting Director of the United States Patent and Trademark Office*